US005144191A

United States Patent [19]

Jones et al.

[11] Patent Number: 5,144,191

[45] Date of Patent: Sep. 1, 1992

[54] HORIZONTAL MICROELECTRONIC FIELD EMISSION DEVICES

[75] Inventors: Gary W. Jones; Ching-Tzong Sune, both of Raleigh, N.C.

[73] Assignee: MCNC, Triangle Park, N.C.

[21] Appl. No.: 714,275

[22] Filed: Jun. 12, 1991

[51] Int. Cl.[5] ..... H01J 19/24

[52] U.S. Cl. ..... 313/308; 313/309; 313/336; 313/351

[58] Field of Search ..... 313/308, 309, 336, 351

[56] References Cited

U.S. PATENT DOCUMENTS

| | | | |
|---|---|---|---|
| 3,982,147 | 9/1976 | Redman . | |
| 4,008,412 | 2/1977 | Yuito et al. . | |
| 4,163,949 | 8/1979 | Shelton . | |
| 4,325,084 | 4/1982 | van Gorkom et al. . | |
| 4,554,564 | 11/1985 | van Gorkom et al. . | |
| 4,574,216 | 3/1986 | Hoeberechts et al. . | |
| 4,578,614 | 3/1986 | Gray et al. . | |
| 4,663,559 | 5/1987 | Christensen . | |
| 4,721,885 | 1/1988 | Brodie . | |
| 4,728,851 | 3/1988 | Lambe . | |
| 4,827,177 | 5/1989 | Lee et al. . | |
| 4,835,438 | 5/1989 | Baptist et al. . | |
| 4,916,356 | 4/1990 | Ahern et al. . | |
| 4,940,916 | 7/1990 | Borel et al. . | |
| 4,956,574 | 11/1990 | Kane | 313/308 X |
| 5,053,673 | 10/1991 | Tomii et al. | 313/309 X |

FOREIGN PATENT DOCUMENTS

| | | | |
|---|---|---|---|
| 0033833 | 2/1989 | Japan | 313/336 |

*Primary Examiner*—Palmer C. DeMeo

*Attorney, Agent, or Firm*—Bell, Seltzer, Park & Gibson

[57] ABSTRACT

A microelectronic field emitter includes a horizontal emitter electrode and a vertical extraction electrode on the horizontal face of a substrate. An end of the horizontal emitter electrode and the end of the vertical extraction electrode form an electron emission gap therebetween. The emitter electrode may be formed on an insulating layer which is formed on a substrate. The insulating layer also includes a sidewall, and the extraction electrode may be formed on the sidewall with one thereof extending adjacent the emitter electrode to form an electron emission gap therebetween. A vertical collector electrode may also be formed on the sidewall of a second insulating layer spaced from the first sidewall. The field emitter may be cylindrical, planar, or of various other shapes. multiple emitters, extractors and collectors may be stacked on one another. The emitters may be formed using conventional microelectronic fabrication techniques, in which an insulating layer is etched to form a sidewall and conformal metallization is used to form extractor and collector electrodes. A low capacitance, high speed, high power horizontal microelectronic emitter may thereby be formed.

28 Claims, 11 Drawing Sheets

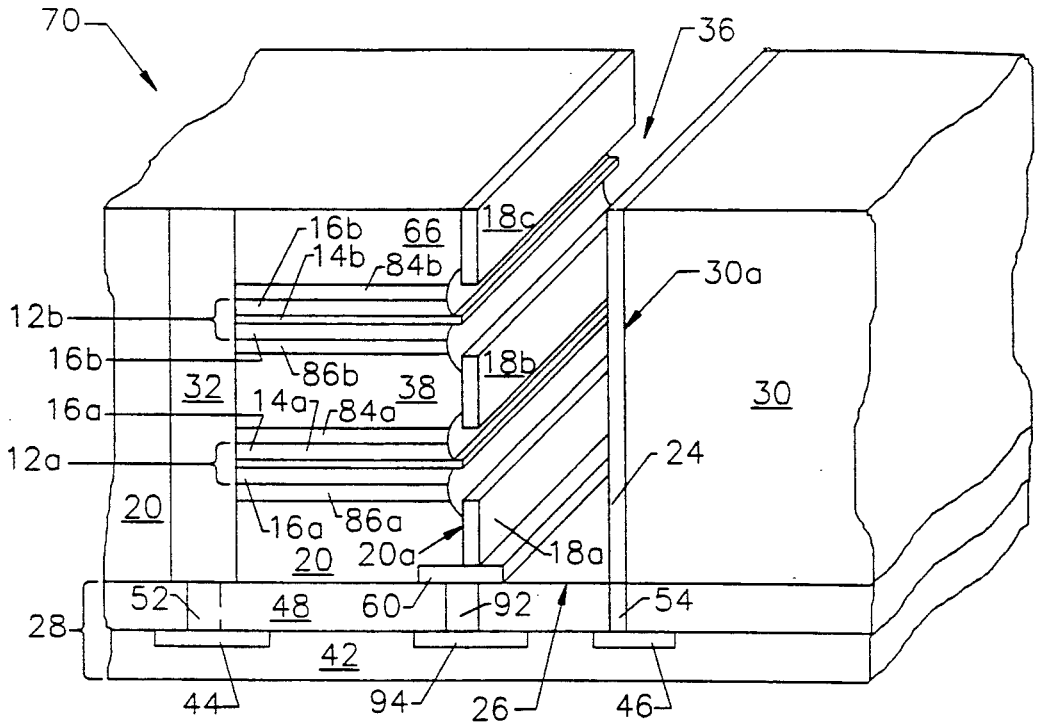
FIG. 3.
FIG. 4.
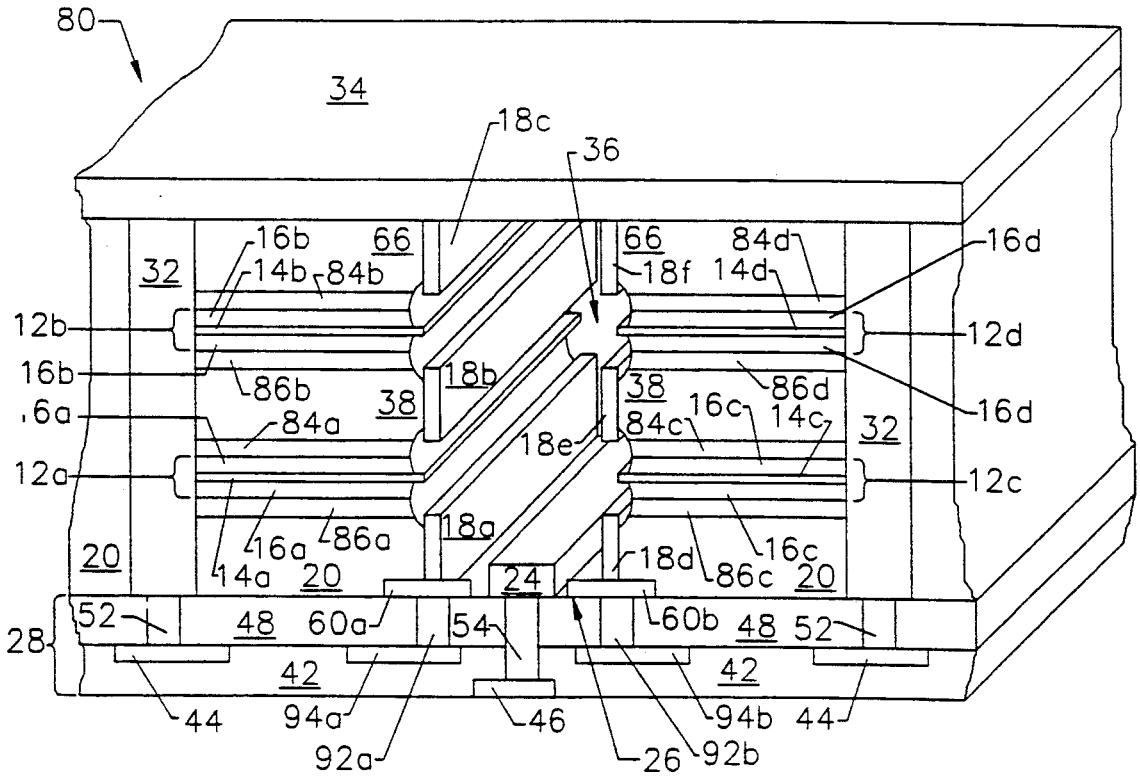

HORIZONTAL MICROELECTRONIC FIELD EMISSION DEVICES

FIELD OF THE INVENTION

This invention relates to semiconductor devices and fabrication methods and more particularly to microelectronic field emission devices and methods of fabricating the same.

BACKGROUND OF THE INVENTION

Microminiature emitters are well known in the microelectronics art, and are often referred to as "field emitters". These microminiature field emitters are finding widespread use as electron sources in microelectronic devices. For example, field emitters may be used as electron guns. When the electrons are directed to a cathodoluminescent material they may be used for high density display devices. Moreover, the field emitter may be coupled to appropriate microelectronic control electrodes to produce a microelectronic analog to a vacuum tube and thereby produce vacuum integrated circuits.

A field emitter typically includes a microelectronic field emission electrode. The field emission electrode typically includes a pointed tip, to enhance electron emissions. Conical pointed tips and linear pointed tips are often used. An extraction electrode is typically provided adjacent but not touching the field emission tip, to form an electron emission gap therebetween. Upon application of an appropriate voltage between the field emission electrode and the extraction electrode, quantum mechanical tunneling or other known phenomena cause the tip to emit an electron beam. In microelectronic applications, an array of field emission tips may be formed on the horizontal face of a substrate such as a silicon semiconductor substrate. Extraction electrodes and other electrodes as necessary may also be provided on the substrate. Support circuitry may also be fabricated on or in the substrate, using well known microelectronic techniques.

Field emitters may be classified as either "vertical" field emitters or "horizontal" field emitters, depending upon the orientation of the emitted electron beam relative to the horizontal substrate face. In a vertical field emitter, one or more emitter tips are formed on the horizontal face of a substrate to emit electrons vertically, i.e. perpendicular to the face of the substrate. A plurality of horizontal electrode layers may be formed on, and generally parallel to, the substrate face, to provide extraction electrodes and other control electrodes as necessary. Such vertical field emitters are described in U.S. Pat. No. 4,008,412 to Yuito et al.; U.S. Pat. No. 4,163,949 to Shelton; U.S. Pat. No. 4,578,614 to Gray et al.; U.S. Pat. No. 4,663,559 to Christensen; U.S. Pat. No. 4,721,885 to Brodie; U.S. Pat. No. 4,85,438 to Baptist et al. and U.S. Pat. No. 4,940,916 to Borel et al.

Unfortunately, vertical field emitters have heretofore been difficult to manufacture and have been limited in power handling capacity and speed. In particular, it has heretofore been difficult to form the vertical emitter tips and the plurality of horizontal electrode layers on the semiconductor substrate adjacent but not touching one another. Moreover, because the electrode layers are typically thin metal layers, they are limited in their power handling capacity Finally, because the electrode layers are separated from one another by thin insulating layers, the resulting device capacitance is high, thereby limiting device speed.

The second class of emitters is generally referred to as "horizontal" emitters. Horizontal emitters emit a beam of electrons generally parallel to the horizontal face of the substrate on which they are formed. Typically, these emitters are formed by fabricating discrete horizontal emitters and horizontal electrodes in a single horizontal layer parallel to the horizontal face of the semiconductor substrate. In other words, horizontal emitters, horizontal extraction electrodes and horizontal collector or other electrodes are formed. See for example U.S. Pat. No. 4,728,851 to Lambe and U.S. Pat. No. 4,827,177 to Lee et al.

Unfortunately, horizontal field emitters have also been difficult to manufacture and have been limited in power handling capacity and speed. In particular, the manufacture of a horizontal field emitter has required the formation of discrete horizontal microelectronic structures in a single horizontal layer on a substrate. It has been difficult to fabricate these small, discrete horizontal structures with a small spacing therebetween. Moreover, the emitter and electrode layers have typically been formed of thin film, closely spaced metallization layers, thereby limiting power handling capacity and device speed.

SUMMARY OF THE INVENTION

It is therefore an object of the invention to provide a high performance microelectronic field emitter and method of making the same.

It is another object of the invention to provide a low capacitance microelectronic emitter which performs at high speed.

It is still another object of the invention to provide a microelectronic emitter with high power handling capacity.

It is yet another object of the present invention to provide a horizontal microelectronic emitter which includes a small electron emission gap.

It is still another object of the present invention to provide a method of manufacturing a high speed, high power, horizontal microelectronic field emitter using well known microelectronic manufacturing techniques.

These and other objects are provided according to the present invention by a horizontal microelectronic field emitter which includes a electrode, on the horizontal face of a substrate. An end of the horizontal emitter electrode and an end of the vertical extraction electrode form an electron emission gap therebetween. Preferably, the emitter electrode is formed on an insulating layer on the face of a substrate. The insulating layer also includes a sidewall, and the extraction electrode is formed on the sidewall with one end thereof extending adjacent one end of the emitter electrode. The one end of the emitter electrode and the one end of the extraction electrode form an electron emission gap therebetween. It will be understood by those having skill in the art that when an element is described herein as being "on" another element, it may be formed directly on the element at the top, bottom or side surface thereof, or one or more intervening layers may be provided between the elements. It will also be understood that the terms "horizontal" and "vertical" are used herein to indicate the general orientation of elements relative to one another, rather than defining a precise orthogonal relationship of elements.

Since the emitter electrode of the present invention is horizontal, it may be formed of thick layers of high conductivity metal surrounding a very thin emitter tip metal, so that high power handling may be provided, with low resistivity. Moreover, since the vertical extraction electrode is formed on the sidewall of the insulating layer, a small electron emission gap may be obtained, with the gap size being determined by thin film deposition techniques rather than by lithography. High fields may thereby be obtained, at reasonable extraction currents and at moderate voltages. Finally, since the extraction electrode and emitter electrode are generally perpendicular to one another, the insulating layer may be relatively thick, thereby decreasing the capacitive coupling between the emitter and extraction electrodes to thereby provide a high speed device.

The field emitter of the present invention, with its horizontal emitter electrode and vertical extraction electrode, may be formed in a number of configurations depending on the specific application involved. In particular, a second insulating layer may be formed on the substrate face, with the second insulating layer also having a sidewall, spaced from the first sidewall, to define a cavity. A collector electrode may be formed on the sidewall of the second insulating layer, so that vertical extractor and collector electrodes may be provided for the horizontal emitter electrode. A cap may be formed on the first and second insulating layers, bridging the cavity, to encapsulate the cavity. The cavity may be evacuated or filled with gas.

The field emitter device of the present invention may be cylindrical, in which case the first insulating layer is a cylindrical insulating layer with a cylindrical first sidewall. The emitter electrode is a circular (i.e. ring or disk shaped) emitter electrode on the top surface of the cylindrical sidewall, and the extraction electrode is a cylindrical extraction electrode on the first sidewall. A circular electron emission gap is thereby formed, with electrons emitted radially outward from the circular emitter. A second insulating layer may be formed surrounding the first insulator, and having a second cylindrical sidewall concentric with the first cylindrical sidewall. A cylindrical collector electrode may be formed on the second sidewall. In another cylindrical embodiment, a ring-shaped emitter may emit electrons radially inward, towards vertical, cylindrical, extractor and collector electrodes.

The field emitter of the present invention may also be planar, as opposed to cylindrical. The first insulating layer may have a planar sidewall, with the emitter electrode being a planar horizontal electrode on the insulating layer, and the extraction electrode being a planar vertical electrode on the sidewall, to thereby form an elongated electron emission gap. A second insulating layer may be formed on the substrate. The second insulating layer includes a second planar sidewall spaced from and parallel to the first planar sidewall, and a vertical collector electrode may be formed on the second planar sidewall. It will also be understood by those having skill in the art that shapes other than cylindrical and planar may be used for particular device applications.

A plurality of horizontal emitter electrodes may be vertically stacked on one another between one or more insulating layers. A single vertical extraction electrode or a plurality of extraction electrodes may be formed on the resultant insulating layer sidewalls. Similarly, one or more collector electrodes may be formed. A collector electrode may also be located on the face of the substrate adjacent the first sidewall, rather than, or in addition to, being located on a second sidewall spaced from the first sidewall. The collector electrode may be a light emissive material or an x-ray emissive material, to form a light or x-ray source.

The field emitter of the present invention may also include a metal layer, parallel to and spaced from an emitter electrode by an intervening insulating layer. The emitter electrode and the metal layer form a capacitive emitter structure. Charge may be injected onto the capacitive emitter using a second emitter located opposite the capacitive emitter. A high speed, radiation hardened Dynamic Random Access Memory (DRAM) cell is thereby formed. A predetermined charge may be stored on the capacitive emitter in a write operation, and stored charge may be sensed in a read operation. The DRAM cell must be refreshed periodically, to restore charge that has leaked from the capacitive emitter.

The field emitter of the present invention may also be coupled to a feedback capacitor to produce an oscillator. A programmable piezoelectric capacitor, having a dielectric made from, for example, sol gel lead zirconate titanate, may also be produced. Also, by varying the spacing between the emitter electrode, collector electrode and/or extraction electrode, the shape of the emitted frequency bands may be varied, or multiple frequency oscillators may be produced. Such multiple frequency oscillators may be used to create a carrier frequency with signal overlay, or a multistate memory.

The field emitter of the present invention may be fabricated by forming an insulating layer on the face of a substrate. An emitter electrode is formed on the insulating layer. A portion of the insulating layer is then removed to form a first sidewall. An extraction electrode is then formed on the first sidewall.

If multiple horizontal emitters are to be formed, a plurality of emitter electrodes and insulating layers may be formed. A portion of the multiple emitter electrodes and insulating layers may then be etched to the substrate face, to form the first sidewall. The first sidewall may then be metallized to form the extraction electrodes. The etching process may also form the second sidewall, spaced from the first sidewall. The second sidewall may be metallized, simultaneous with the extraction electrode, to form the collector electrode. A horizontal emitter having a vertical extractor electrode may thereby be formed using well known microelectronic techniques.

BRIEF DESCRIPTION OF THE DRAWINGS

FIG. 3 illustrates a perspective view of a planar microelectronic field emitter having multiple emitters on a sidewall according to the present invention.

FIG. 4 illustrates a perspective view of a field emitter having multiple emitters on a pair of sidewalls and a collector on the substrate face, according to the present invention.

DESCRIPTION OF A PREFERRED EMBODIMENT

The present invention now will be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
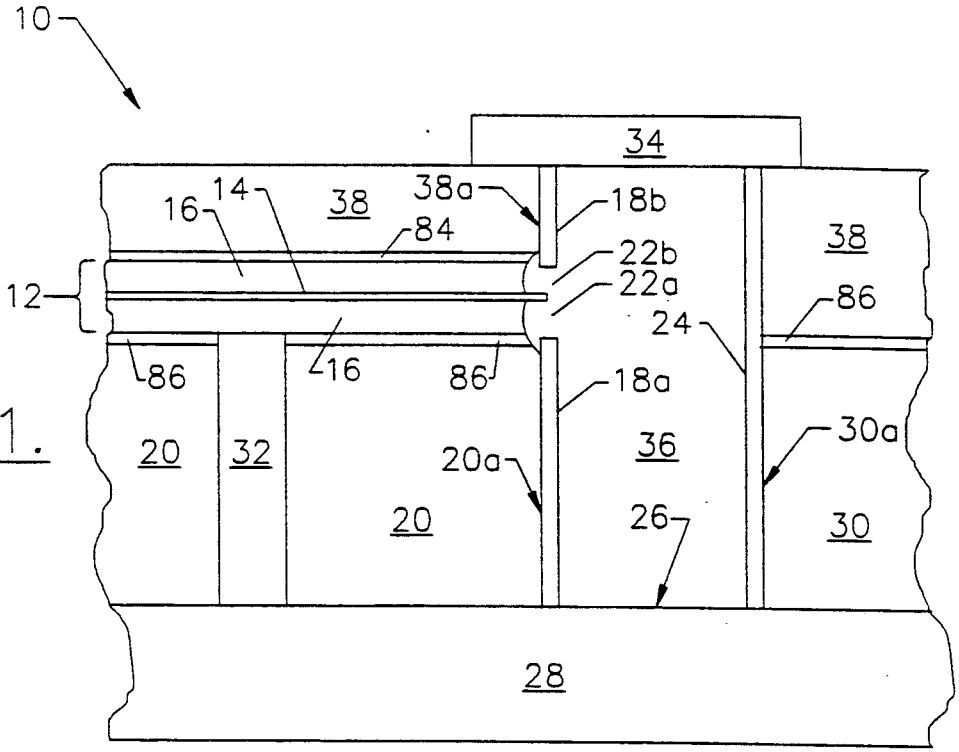
FIG. 1 illustrates a simplified cross-sectional view of a microelectronic field emitter according to the present invention.

Referring now to FIG. 1, a simplified cross-sectional view of a microelectronic field emitter according to the present invention will now be described. As shown in FIG. 1, field emitter 10 is formed on substrate 28, having first insulating layer 20 on horizontal face 26 thereof. It will be understood by those having skill in the art that when an element is described herein as being "on" another element, it may be formed directly on the element, at the top, bottom or side surface thereof, or one or more intervening layers may be provided between the elements. Accordingly, field emitter 10 may be formed directly on substrate 28 as shown, or one or more intervening may be included between face 26 and emitter electrode 12. Horizontal emitter electrode 12 is formed on first insulating layer 20. Emitter electrode 12 may be formed of thick layers 16 of high conductivity metal surrounding a thin emitter tip 14. Also shown in FIG. 1 are optional insulating layers 84 and 86, formed immediately above and below emitter electrode 12. Insulating layers 84 and 86 may be used to define the distance between extraction electrode 18 and the emitter tip 14 to make certain the electrodes do not touch, and a small, well defined electron emission gap 22 is formed.

A vertical extraction electrode 18*a* is formed on sidewall 20*a* of first insulating layer 20. An electron emission gap 22*a* is thereby formed between one end of horizontal emitter electrode 12 and one end of vertical extraction electrode 18*a*. As also shown, a vertical collector electrode 24 may be formed on sidewall 30*a* of second insulating layer 30. As also shown, a second extraction electrode 18*b* may also be formed on sidewall 38*b* of third insulating layer 38. A second electron emission gap 22*b* is thereby formed between one end of emitter electrode 12 on second insulating layer 38 and one end of extraction electrode 18*b* on the sidewall of second insulating layer 38. An electron emission gap 22*a*, 22*b* may thereby be provided below and above emitter tip 14.

If a collector is not provided, device 10 may operate as a field emission diode. If a collector 24 is provided, device 10 may operate as a field emission transistor. Optical or x-ray emission may be obtained using an electrically conductive, electron sensitive, light or x-ray emitting material as the collector 24.

Still referring to FIG. 1, emitter connector 32 electrically connects emitter 12 to substrate 28. Substrate 28 may include external electrical connections for emitter electrode 12, extractor electrode 18 and collector electrode 24 (not shown), as will be described in detail below. Substrate 28 may also include other microelectronic circuitry, not shown. Optional cap 34 may be formed on second and third insulating layers 30 and 38, respectively. Cap 34 encapsulates cavity 36 in the microelectronic emitter to form a vacuum microelectronic integrated circuit structure. Other gases may also be encapsulated in cavity 36 for various applications. For example, hydrogen may be used to minimize chemical degradation of the emitter.

As may be seen from the simplified diagram of FIG. 1, the horizontal emitter electrode 12 is sandwiched between thick dielectric layers 20 and 38, to thereby form a high speed device with reduced parasitic capacitance. Moreover, the emitter electrode 12 may be fabricated using thick emitter layers 16 and a thin emitter tip 14, thereby providing a low resistivity emitter. The extraction electrode 18 may be separated from the emitter by thick dielectric layers 20 and 38, thereby further reducing stray capacitance. However, notwithstanding the large spacing between extraction electrode 18 and emitter electrode 12, a small extraction electrode to emitter gap 22 may be provided so that a high electric field and a large extracted current may be obtained at moderate extraction voltages. Accordingly, a high speed, high efficiency device may be fabricated.

A variety of field emitter structures may be provided according to the present invention, to suit a variety of applications. A number of sample structures will now be described.

Figure 2:
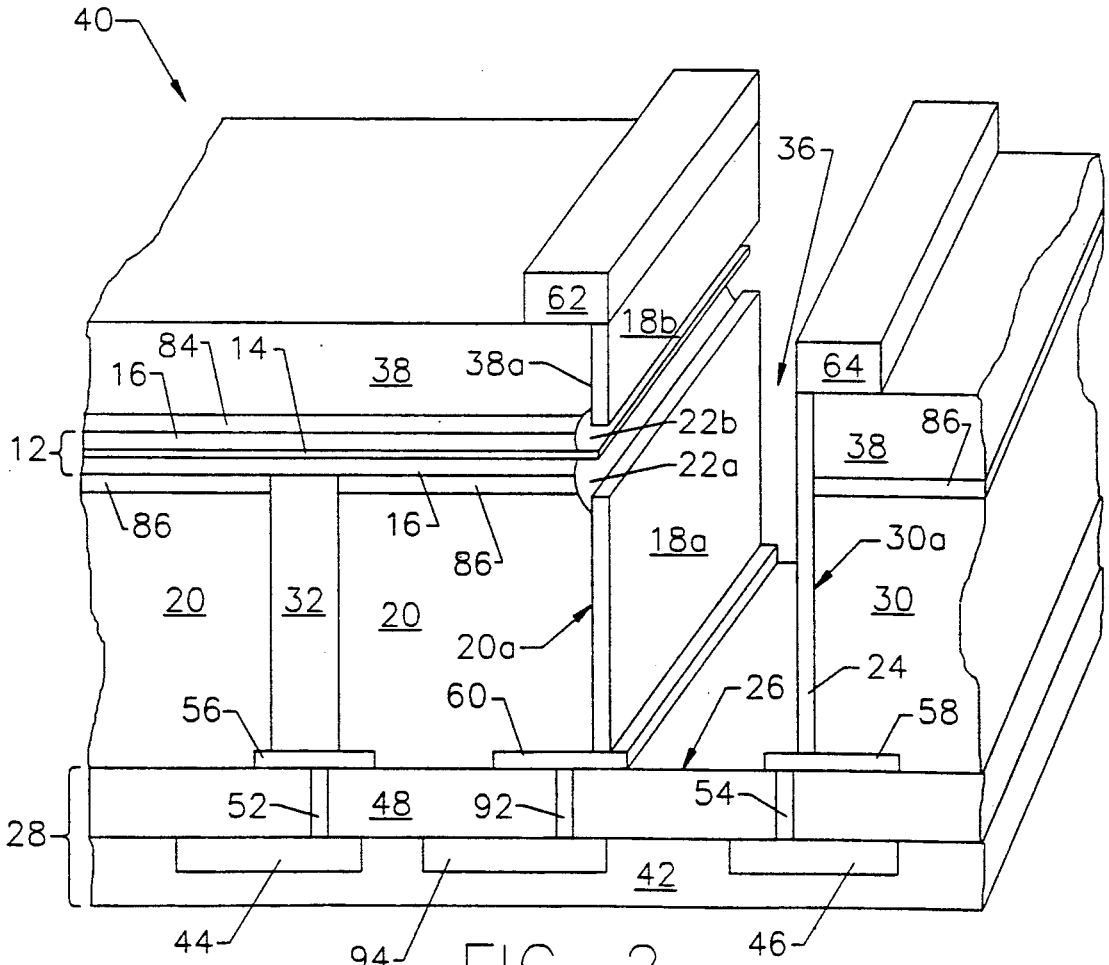
FIG. 2 illustrates a perspective view of a planar microelectronic field emitter according to the present invention.

Referring to FIG. 2, a perspective view of a planar field emitter according to the present invention will now be described. As shown in FIG. 2, field emitter 40 includes a planar vertical extraction electrode 18*a* and a planar horizontal emitter electrode 12, to thereby form an elongated electron emission gap 22 therebetween. Extraction electrode 18*a* is formed on sidewall 20*a* of first insulating layer 20, and emitter either directly, or with optional insulating layer 86. As also already described, a collector electrode 24 may be formed on the sidewall 30*a* of second insulating layer 30. A third insulating layer 38 may be formed on emitter 12, with an extraction electrode 18*b* formed on the sidewall 38*a* thereof. Optional insulating layer 84 may also be formed.

FIG. 2 also shows additional detail of substrate 28. As shown, substrate 28 may include a plurality of layers. For example, a silicon or other microelectronic substrate 42 may include a contact 44 for emitter 12, a contact 46 for collector 24, and a contact 94 for extractor 20*a*. These contacts may be connected to external pins or other input/output devices, or may form a contact to other microelectronic circuitry (not shown) formed within semiconductor substrate 42. Substrate 42 may also take the form of a multilayer wiring substrate which is widely used for packaging high density microelectronic devices. As also shown in FIG. 2, an insulating layer 48 may be formed on substrate 42. The insulating layer may include a plurality of vias 52, 54 and 94 for connecting pads 56, 58 and 94 in insulating layers 20 and 30 respectively, to the emitter contact, collector contact and extractor contact 44, 46 and 94, respectively.

It will be understood by those having skill in the art that other interconnection techniques may also be used. For example, as shown in FIG. 2, a top extractor electrode contact 62 and a top collector electrode contact 64 may be used, together with or instead of bottom contacts 58 and 60, to electrically contact the extractor electrode 18*b* and collector electrode 24 respectively. Alternatively, if these contacts are not necessary for the particular application, layers 62 and 64 may be formed as insulating layers, or these layers may be omitted. Finally, depending on the particular application, a cap (not shown in FIG. 2) may be provided on layers 62 and 64, bridging cavity 36, in order to allow evacuation of cavity 36 or filling of cavity 36 with an appropriate gas.

Referring now to FIG. 3, a planar, multiple emitter structure 70 according to the invention is shown. In this structure, a plurality of emitter electrodes 12*a* and 12*b* are connected to a common emitter connector 32 via backside connections. A plurality of extraction electrodes 18*a*–18*c* may be individually or collectively controlled. The field emitter structure 70 of FIG. 3 includes a single collector electrode 24. However, it will be understood by those having skill in the art that a plurality of collector electrodes may also be formed, and may be individually controlled.

The multiple emitter structure 70 of FIG. 3 may be used as a transistor which can produce current flow in either direction by simply changing the bias conditions. Moreover, by operating the multiple emitters in parallel, a source of high intensity electrons may be obtained. It will be understood by those having skill in the art that because microelectronic techniques allow emitter electrodes 12*a* and 12*b* to be precisely spaced from and aligned to one another, opposing, highly aligned electron beam sources may be produced. High intensity magnetic fields (not shown) may also be used to confine electrons in the cavity 36. A cap 34 (not shown in FIG. 3) may be provided, which may have a mirrored bottom surface to create resonance of light beams and thereby create a coherent laser light source.

Referring now to FIG. 4, yet another configuration of the multiple emitter structure is described. This multiple emitter structure 80 utilizes emitters on two sidewalls, and eliminates the collector electrode on the sidewall opposing the emitter. A separate collector plate 24 may be provided on face 26 of the substrate. Accordingly, a central collector plate, surrounded by rows of single or multiple emitters and extractors, is thereby provided. This device may provide even higher current and higher frequency performance capability than the devices of FIGS. 2 and 3, at the possible expense of some processing complexity and added chip real estate. As above, it can be used in conjunction with magnetic fields and can operate as a light, x-ray or a laser source. Moreover, the collector electrode 24 may be either a solid rail as shown in FIG. 4, or a row of discrete electrodes to provide the capability of longitudinal modulation control.

Figure 5:
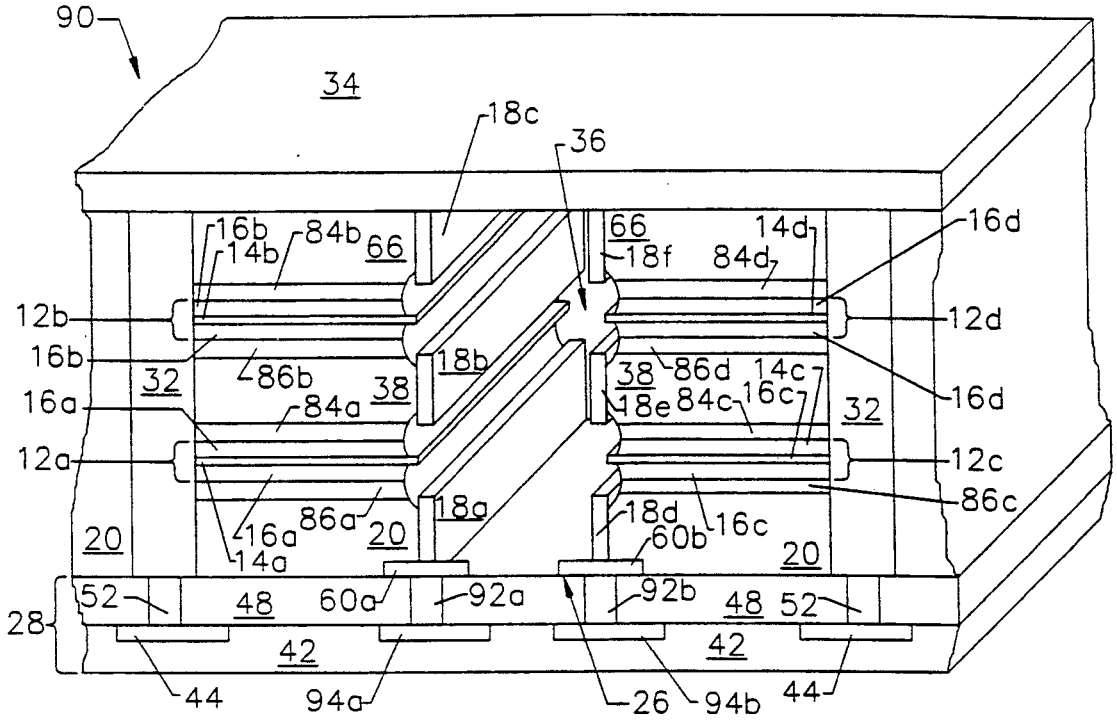
FIG. 5 illustrates a perspective view of a field emitter having multiple emitters on a pair of sidewalls, according to the present invention.

FIG. 5 illustrates a similar configuration to FIG. 4, but which does not include a collector electrode 24. This device 90 may be used as a transistor which can produce current flow in either direction by simply changing bias conditions. It may also be used as a source for high intensity electrons for a free electron light source due to the self aligned, high intensity, opposing electron beams which can be generated. High intensity magnetic fields (not shown) may also be used to confine electrons in the cavity 36, enhance electron-electron interaction, or direct electrons as desired. Mirrored surfaces at the ends of the cavity 36 may be used to create a laser source.

Figure 6:
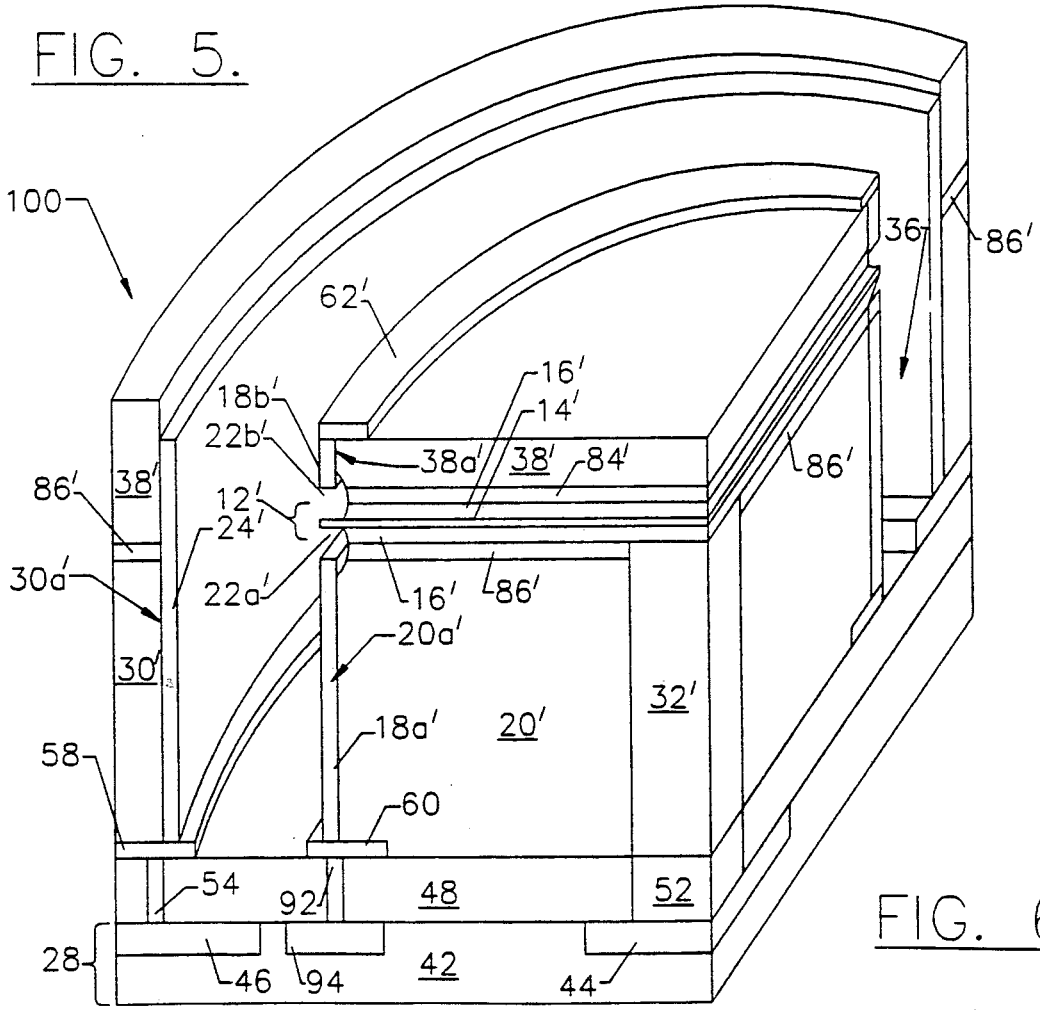
FIG. 6 illustrates a perspective view of one quadrant of a first embodiment of cylindrical field emitter according to the present invention.
Figure 7:
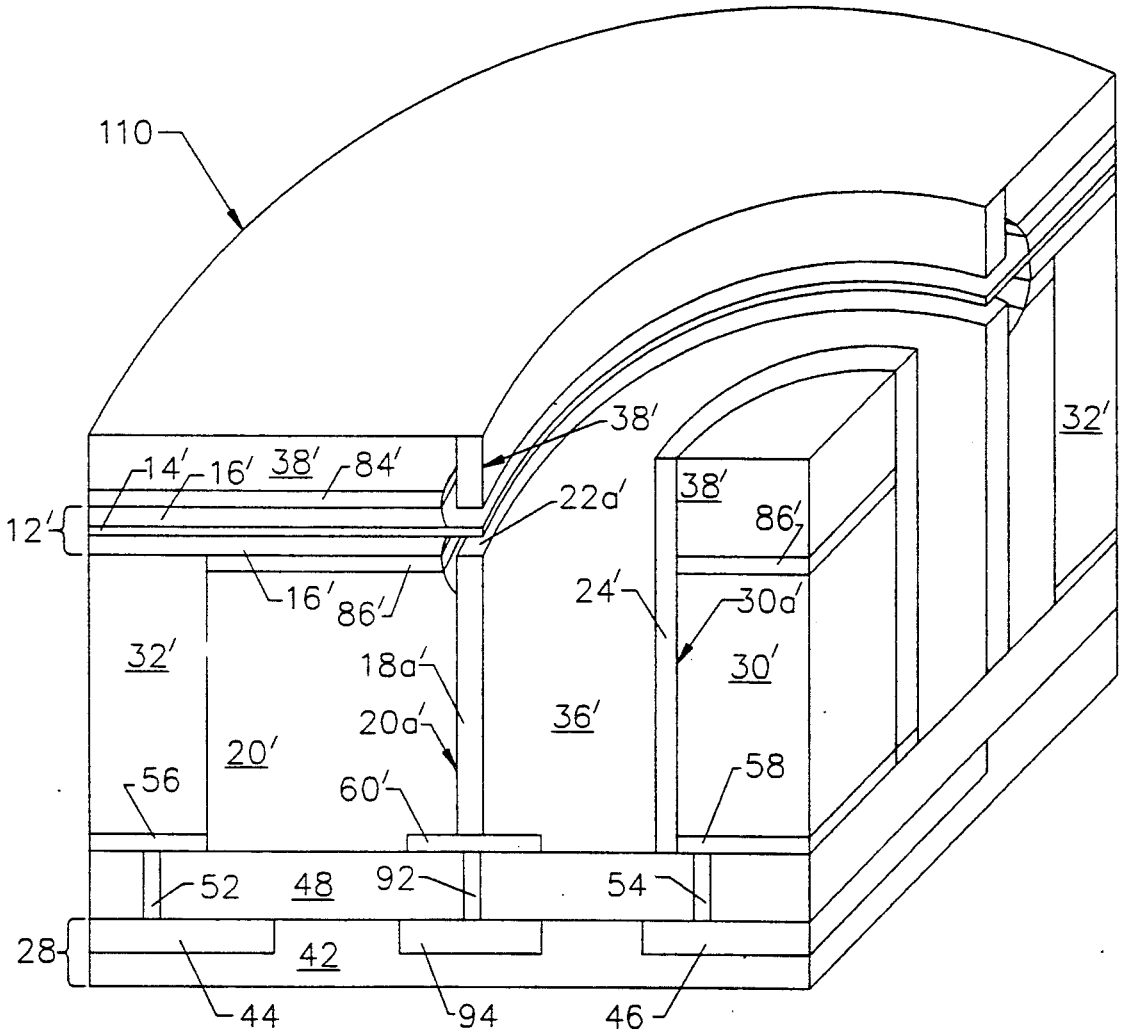
FIG. 7 illustrates a perspective view of one quadrant of a second embodiment of cylindrical field emitter according to the present invention.

The embodiments described in FIGS. 2–5 use planar emitters, extractors and collectors. It will be understood by those having skill in the art that a variety of nonplanar emitters, extractors and collectors may also be used. Referring now to FIGS. 6 and 7, an example of cylindrical field emitters will now be described. For ease of illustration, only one quadrant of the field emitter is shown. In general, reference numbers used in FIGS. 2–5 will be used, except prime (') notation will be used to indicate cylindrical or circular parts, as opposed to the planar parts.

The primary difference between FIGS. 6 and 7 is that the locations of the circular emitter electrode 12' and cylindrical extractor electrode 18', and cylindrical collector 24' are reversed. In particular, in FIG. 6 electrons are emitted radially outward from central disk shaped emitter 12' to cylindrical collector 24'. In FIG. 7 electrons are emitted radially inward from ring shaped emitter 12' to cylindrical collector 24'. In both embodiments, circular electron emission gaps 22' are formed. It will be understood by those having skill in the art that a plurality of circular (disk or ring shaped) emitters may be stacked upon one another to create multiple emitter structures similar to those described in connection with FIGS. 3–5.

Referring now to FIGS. 8A–8J, a sequence of steps for forming the planar emitter of FIG. 2 will be described. It will be understood by those having skill in the art that the sequence of steps described in connection with FIGS. 8A–8J may be modified to form the emitters described in FIGS. 3–7.

Figure 8A:
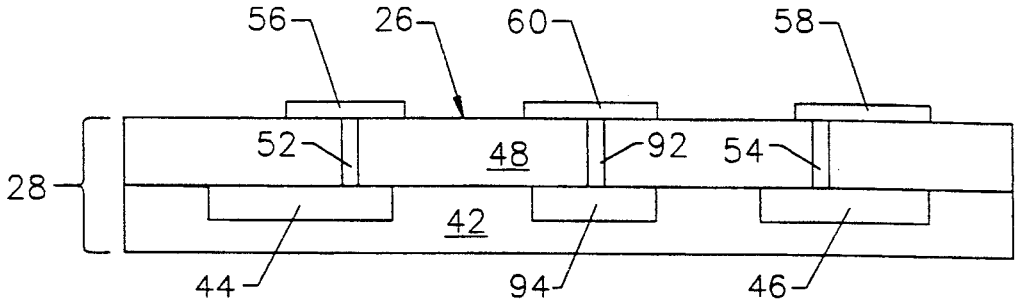
FIGS. 8A–8J schematically illustrate cross-sectional views of a sequence of steps for fabricating a field emitter of the present invention.

Referring now to FIG. 8A, substrate 28 is first formed. As already described, various microelectronic substrates may be formed, utilizing techniques well known to those having skill in the art. As shown in FIG. 8A, a silicon or multilayer wiring substrate 42, having conductors 44, 46 and 94 therein, is first formed. Then, an insulating layer 48 such as 2.0 μm of thermally grown or deposited silicon dioxide is formed on silicon substrate 42. Pads 56, 58 and 60 for the emitter, collector and extractor respectively, may then be formed on face 26 of substrate 28, using well known photolithographic techniques. The pads 56, 58, and 60 are preferably 1 μm aluminum with 0.1 μm TiN or Mo coating.

Figure 8B:
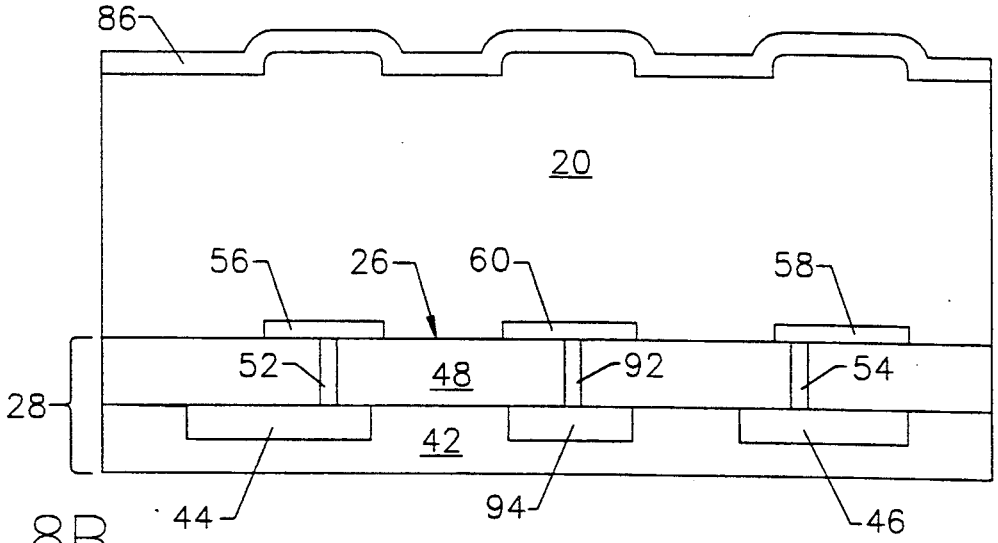

Then, referring to FIG. 8B, first insulating layer 20 is formed on substrate 28. Insulating layer 20 may be formed of chemical vapor deposited silicon dioxide or may be preferably formed by spin coating polyimide. Insulating layer 20 is preferably fairly thick, on the order of 10 μm. As shown in FIG. 8B, insulator 20 tends to conformally deposit so that ridges are formed above pads 56, 58, and 60. Optional insulating layer 86 is then formed on insulating layer 20. Insulating layer 86 is preferably 0.1 μm of silicon dioxide. However, silicon nitride may also be used. As shown, insulating layer 86 is conformally formed on insulating layer 20. It will be understood by those having skill in the art that insulator 86 is preferably differential etching material with insulator 20.

Figure 8C:
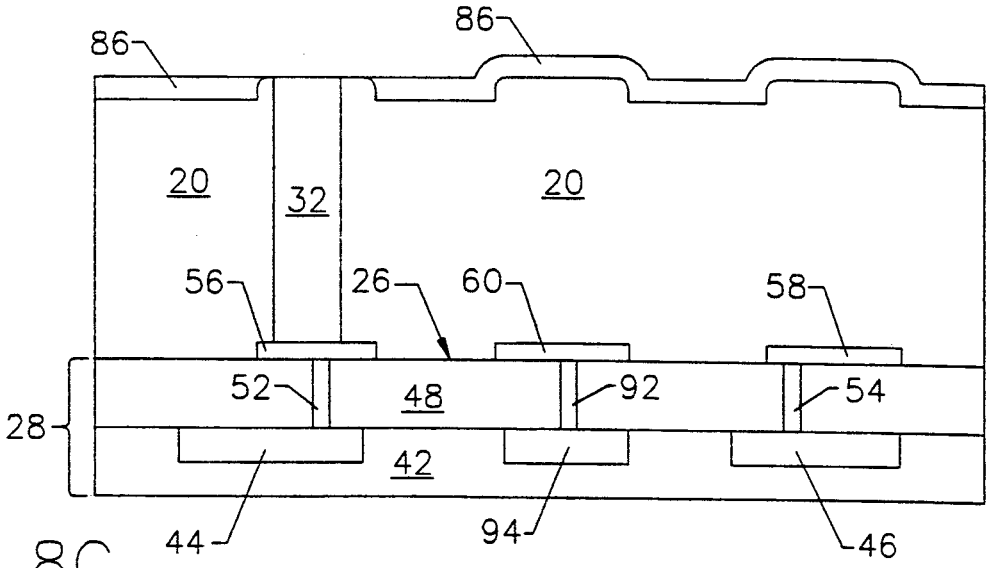

Referring now to FIG. 8C, the emitter connector 32 is formed. A number of well known techniques may be used to form emitter connector 32. For example, insulating layers 20 and 86 may be patterned and etched, and then a conductor may be deposited therein. The conductor may be deposited using selective chemical vapor deposition of tungsten. However, evaporation or blanket deposition and etch techniques may also be used. Alternatively, nickel may be electrodelessly deposited in the etched portion of insulator 20.

Figure 8D:
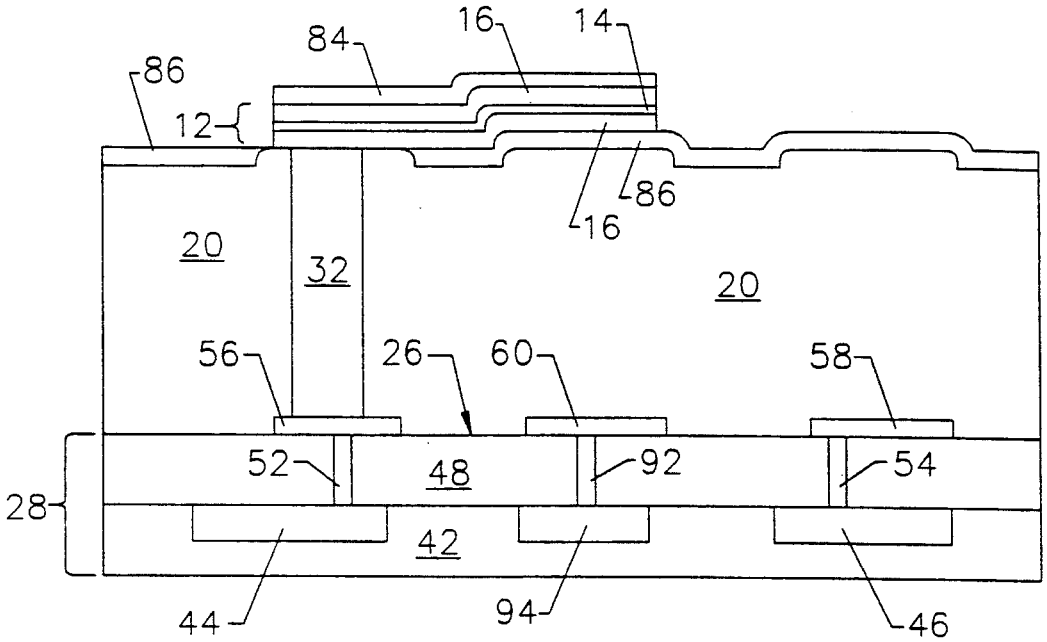

Referring now to FIG. 8D, the emitter electrode 12 is formed. The thin emitter tip 14 is formed between thick emitter layers 16. Preferably, thick emitter layers 16 are 0.4 μm thick layers of aluminum, and emitter tip 14 is a 0.01 μm thick layer of tungsten. However, chromium/-copper layers may also be used instead of aluminum. Finally, optional insulating layer 84 is formed on upper thick emitter layer 16. Insulating layer 84 is preferably 0.1 μm of silicon dioxide, although silicon nitride may also be used.

Still referring to FIG. 8D, layers 86, 16, 14 and 84 are etched to form the emitter 12 shown in FIG. 8D. It will be understood by those having skill in the art that lift-off techniques may also be used to form emitter electrode 12. It will also be understood by those having skill in the art that insulating layers 84 and 86 are optional, and may be used to define the distance between the extraction electrode 18 (formed in FIG. 8I) and the emitter tip 14 to make certain that the electrodes do not touch and a small, well defined electron emission gap is formed.

It will also be understood by those having skill in the art that emitter electrode 12 need not be patterned at this point in the sequence of operations. Rather, the emitter 12 may be left unpatterned and may be patterned later, when cavity 36 is formed, as part of the processing of FIG. 8G.

Figure 8E:
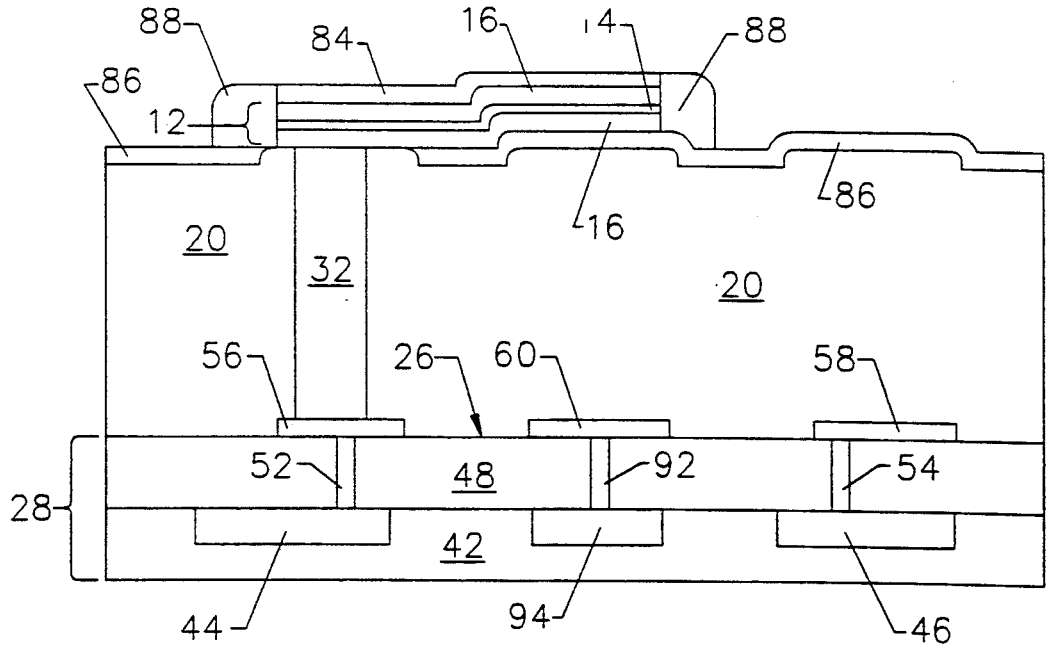

Referring now to FIG. 8E, an optional sidewall spacer 88 is formed around emitter 12, using well known photolithographic techniques. The sidewall spacer is preferably 0.2 μm silicon dioxide or silicon nitride. The sidewall spacer is used to protect the metal layers of emitter electrode 12 during subsequent fabrication steps.

Figure 8G:
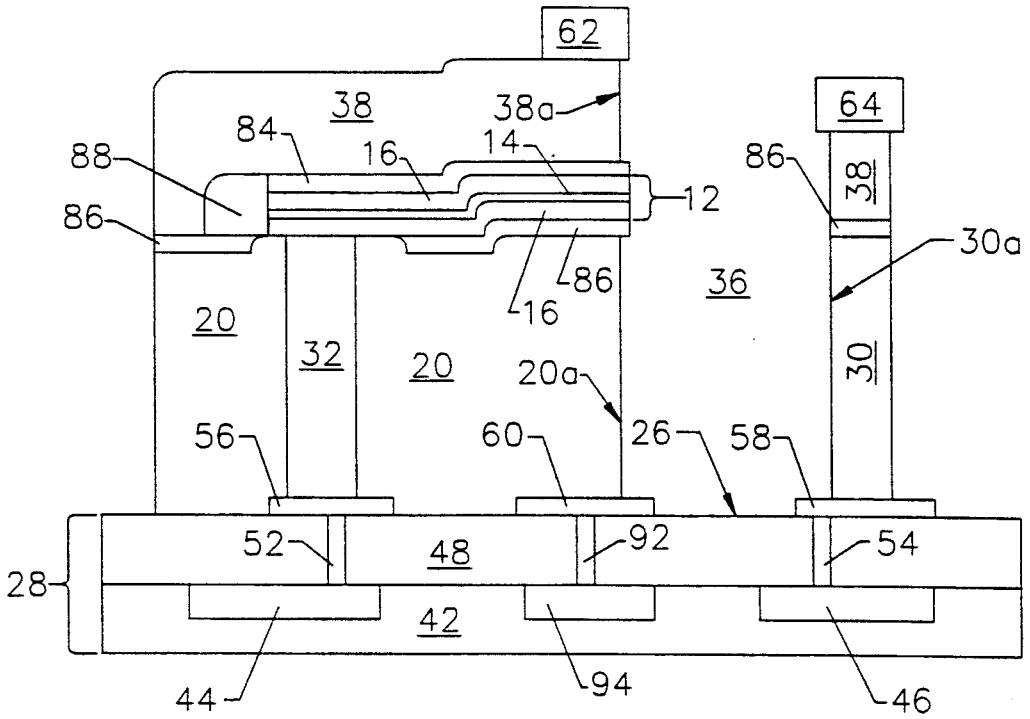
Figure 8H:
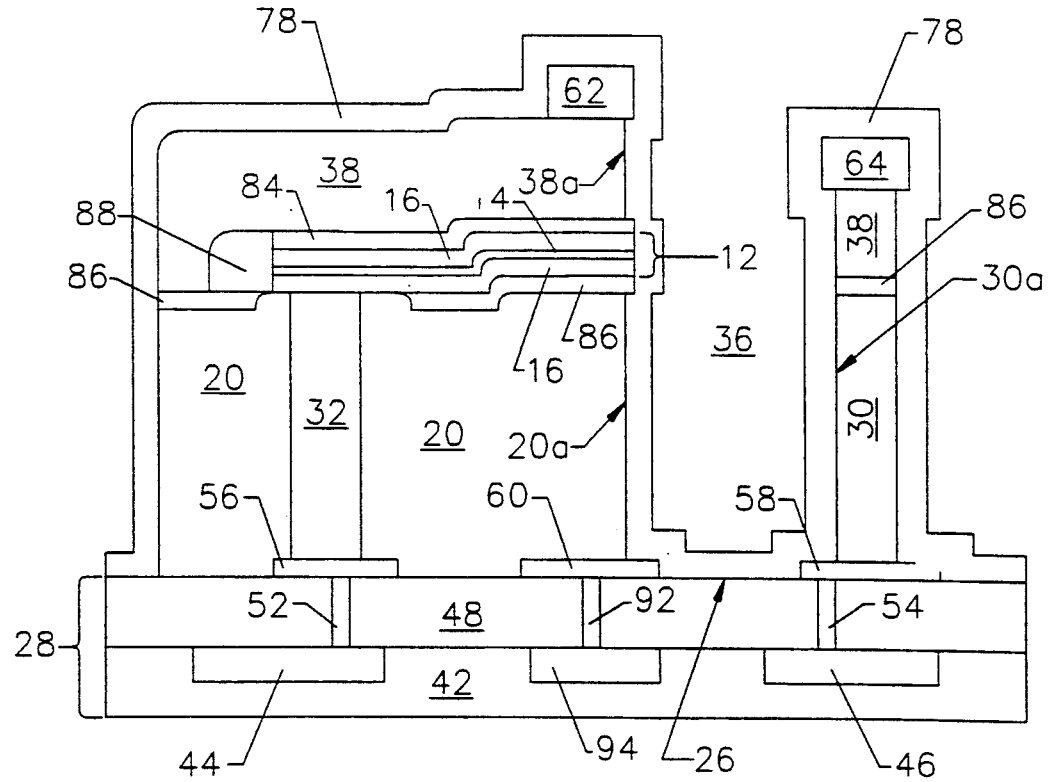
Figure 8I:
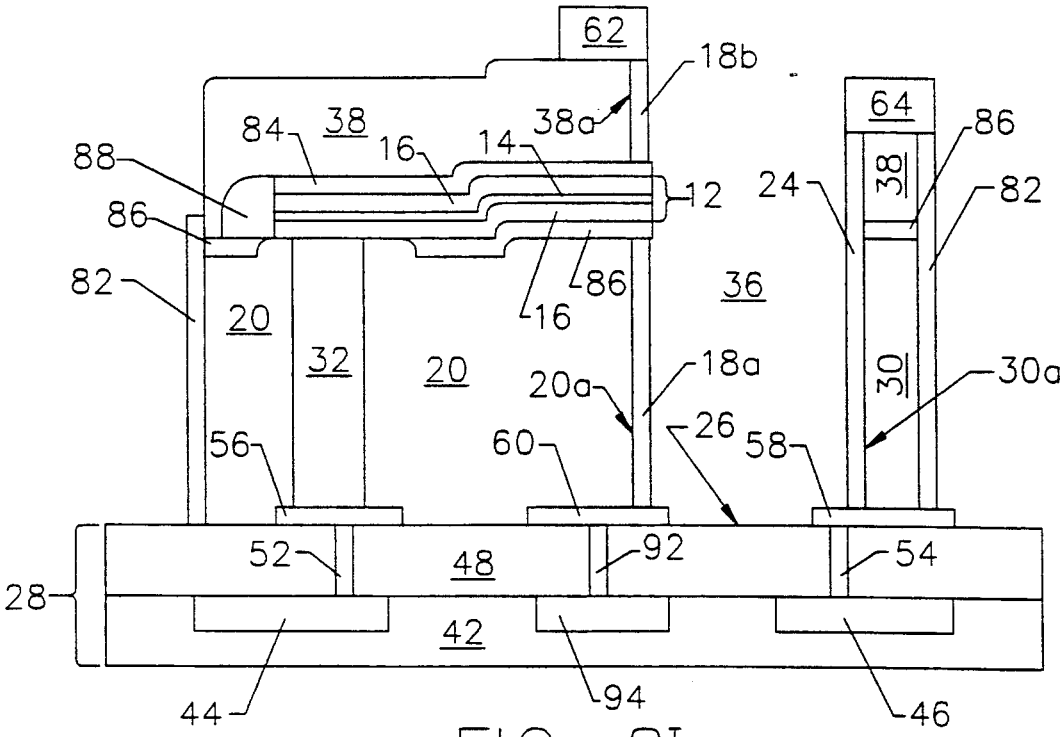
Figure 8J:
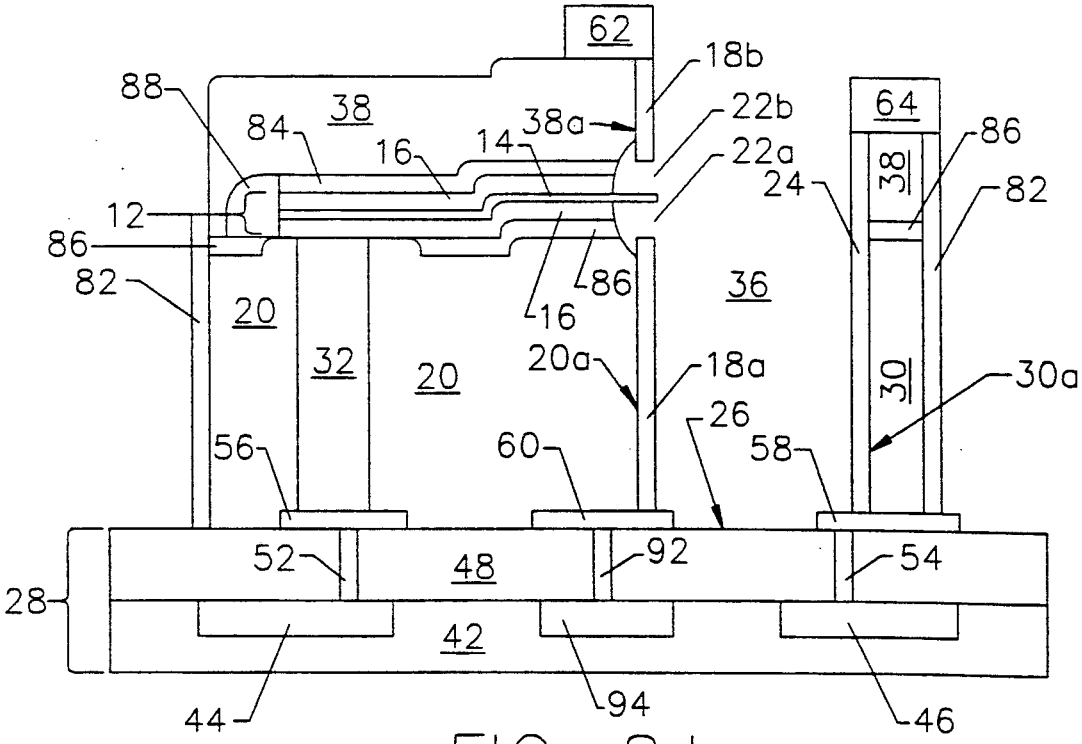
Figure 8F:
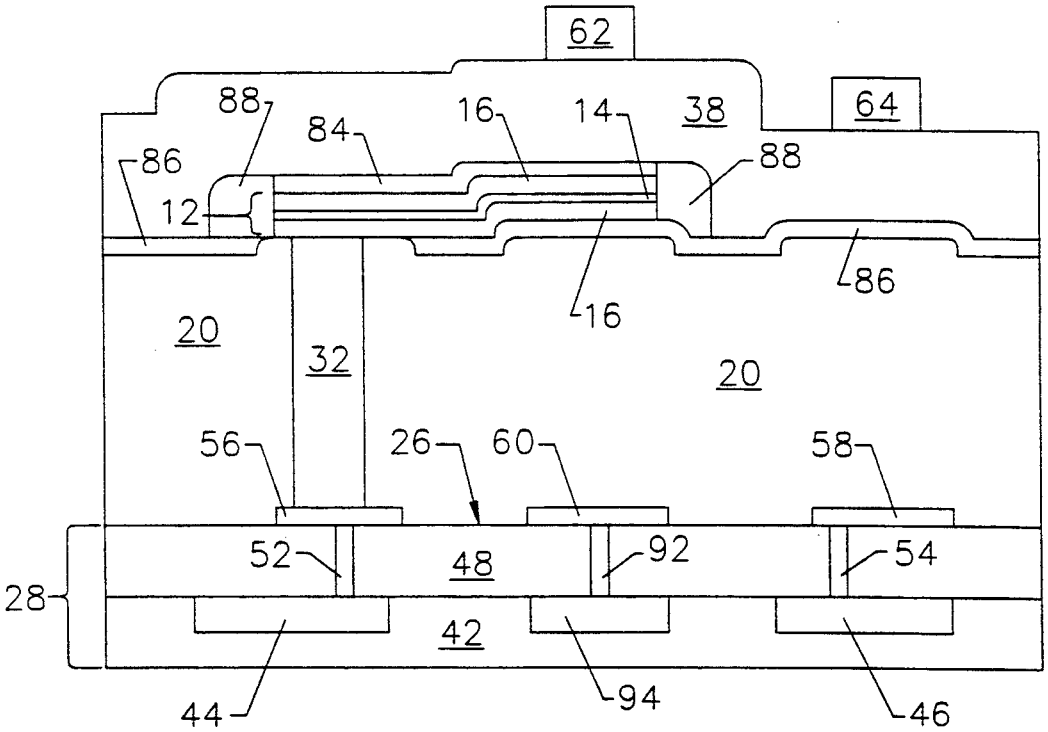

Then, referring to FIG. 8F, insulating layer 38 is formed on the emitter structure. Preferably insulating layer 38 is spun-on polyimide about 1 μm thick, although chemical vapor deposited silicon dioxide may also be used. It will be understood by those having skill in the art that insulating layer 84 is preferably differential etching material with insulating layer 38. If conductors 62 and 64 will be used in the particular application, they may be photolithographically defined as shown. If conductors are not required, insulating layers 62 and 64 may nonetheless be formed, for use in defining the subsequent etch. If conductors are used, they are preferably 0.5 μm aluminum with optional TiN or Mo coatings. If insulators are used, 0.5 μm of silicon nitride is preferably used.

Then, as shown in FIG. 8G, cavity 36 is formed by directionally etching insulating layers 20 and 38 using layers 62 and 64 as a mask. Accordingly, the emitter and extractor electrodes may be self-aligned. A suitable dry etch which can directionally etch insulator 38, insulator 20 and metal emitter electrode 12 is buffered HF in ethylene glycol. If required, the sidewalls **20*a*, 30*a* and 38*a* may be etched back using oxygen plasma to etch back polyimide, or dilute hydrofluoric acid to etch back silicon dioxide, to cause the end of emitter 12 to protrude into cavity 36 as shown in FIG. 8G**.

Referring now to FIG. 8H, the collector and extractor electrodes are formed by conformally depositing a conductor over the entire exposed surface. As shown, conductor 78 may be conformally deposited using chemical vapor deposition. Conductor 78 is preferably tungsten, 1.0 μm thick, although highly doped polysilicon or other known conductors may be used. It will be understood by those having skill in the art that an adhesion layer may be used to ensure adhesion of conformal conductor layer 78 to the underlying material.

Figure 9:
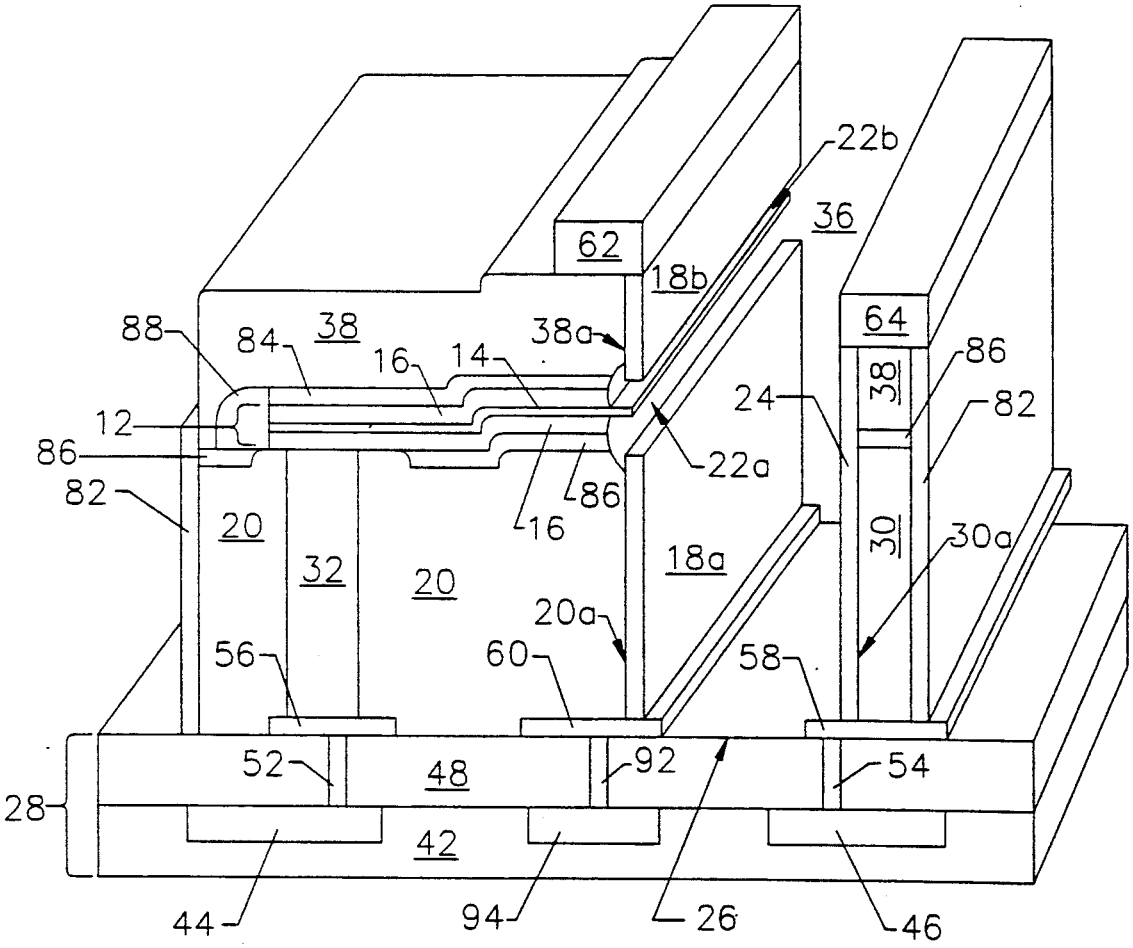
FIG. 9 illustrates a perspective view of the field emitter device of FIG. 8J.

Then, as shown in FIG. 8I, an anisotropic (directional) etch is performed on conformal conductor 78. For example, if conductor 78 is tungsten, a reactive ion etch in sulfur hexafluoride may be performed. As shown, the directional etch substantially etches the horizontal surfaces of conformal conductor 78, but does not substantially etch the vertical surfaces of conductor 78. Accordingly, vertical extraction electrodes **18*a*, 18*b* and collector electrode 24 are formed. The remaining vertical portions 82 of conformal conductor 78 may be removed, or they may remain as shown. Finally, in order to define the electron emission gaps 22*a* and 22*b*, a wet etch of insulating layers 84 and 86 may be performed. The thin emitter tip 14 may be etched back to its desired position and the top and bottom emitter metals 16 may also be etched in order to form a sharp edge as shown in FIG. 8J. FIG. 9 illustrates the completed structure of FIG. 8H** in perspective.

It will be understood by those having skill in the art that many variations in the above described method may be used to form emitters. Cylindrical, ring-shaped and other nonplanar emitters may be formed using a similar sequence of steps including patterning the desired shape. Moreover, multiple emitters, extractors and/or collectors may be formed by repeating at least some of the illustrated steps.

Figure 10:
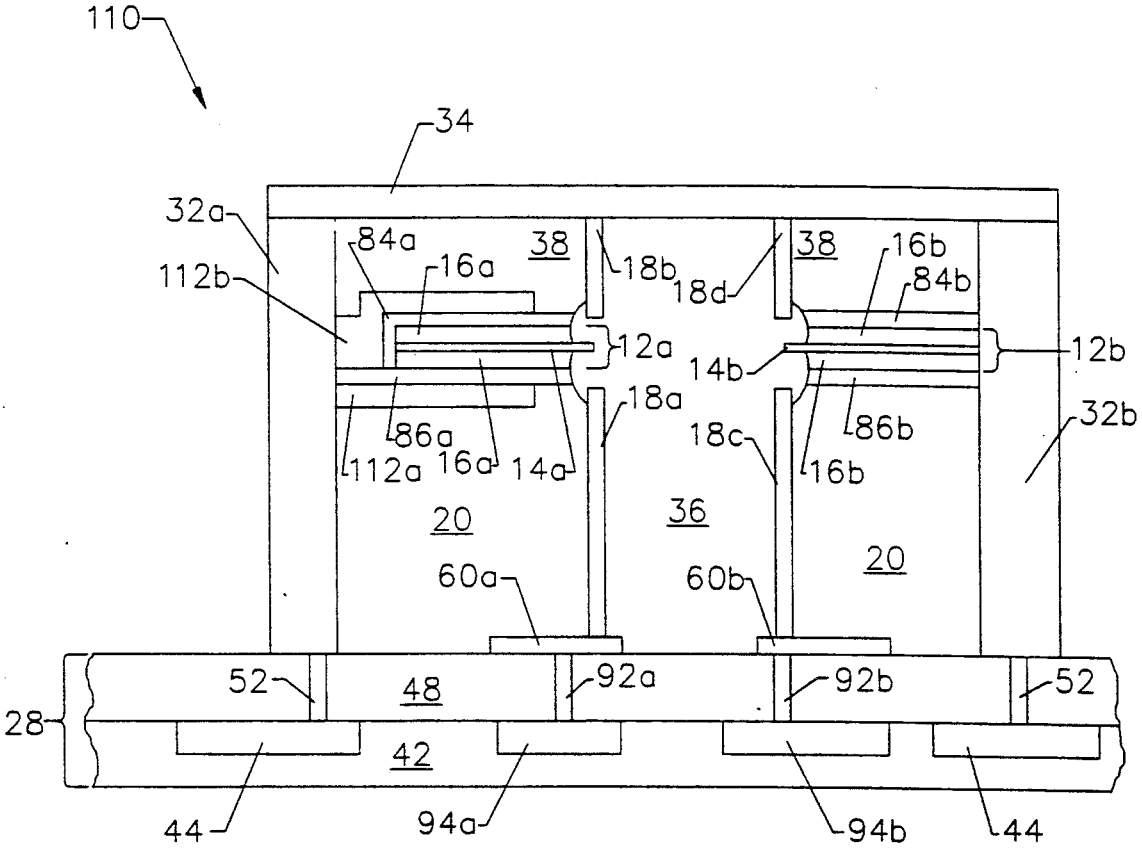
FIG. 10 illustrates a cross sectional view of a field emitter having a charge storing emitter electrode according to the present invention.

Referring now to FIG. 10, an emitter having a charge storing emitter electrode will now be described. Such an emitter may be used to form a high speed, radiation hardened Dynamic Random Access Memory (DRAM) cell. As shown in FIG. 10, field emitter 110 includes an emitter electrode 129 having a pair of metal plate layers **112*a*, 112*b* parallel thereto and spaced therefrom by insulating layers 86*a* and 84*a*, respectively. As shown, connector 32*a* may be used to electrically connect metal plates 112*a* and 112*b*. Alternatively, metal plates 112*a* and 112*b* may be directly connected to one another without using connector 32*a*. As also shown, emitter 12*a* and metal plate layers 112 are electrically floating, i.e. they are insulated from one another and from the other elements of field emitter 110. Accordingly, charge placed on emitter electrode 12*a* will be capacitively stored between emitter electrode 12*a* and plates 112**, limited only by charge leakage.

Field emitter 110 may form a cell of a DRAM, with a binary ONE or ZERO being indicated by the presence or absence of charge On emitter electrode **12*a*. In order to write data into the DRAM cell, charge may be placed on emitter electrode 12*a* by emitter electrode 12*b*, which is coplanar to emitter electrode 12*a* and spaced therefrom across cavity 36. Data may be read or sensed using extractor electrodes 18*a* and 18*b* to extract charge from emitter electrode 12*a*, if present, and using emitter electrode 12*b* and/or extractors 18*c* and 18*d*** to sense the extracted charge, if any.

Field emitter 110 may be fabricated as described above in FIG. 9, with the additional steps of fabricating plate **112*a* on first insulating layer 20 before fabricating emitter 12*a*, and fabricating plate 112*b* on emitter 12*a*** thereafter. A high speed, radiation hardened DRAM cell may thereby be formed.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A microelectronic field emitter comprising:
a horizontal substrate having a horizontal face;
a first insulating layer on said horizontal face, said first insulating layer having a first vertical sidewall;
a first horizontal emitter electrode on said first insulating layer with one end thereof extending adjacent said first vertical sidewall; and
a vertical extraction electrode on said first vertical sidewall with one end thereof extending adjacent said first horizontal emitter electrode, said one end of said first horizontal emitter electrode and said one end of said vertical extraction electrode forming an electron emission gap therebetween and
a horizontal cap, spaced from said horizontal face, for encapsulating said first horizontal emitter electrode and said vertical extraction electrode.

2. The microelectronic field emitter of claim 1 further comprising:
a second insulating layer on said horizontal face, said second insulating layer having a second vertical sidewall, said second vertical sidewall being spaced from said first vertical sidewall to form a cavity therebetween, and
a vertical collector electrode on said second vertical sidewall.

3. The microelectronic field emitter of claim 2 wherein said collector electrode comprises one of a light emissive material and an x-ray emissive material.

4. The microelectronic field emitter of claim 2 further comprising a cap, on said first and second insulating layers, bridging said cavity.

5. The microelectronic field emitter of claim 1 wherein said first vertical sidewall comprises a first planar vertical sidewall; wherein said one end of said first emitter electrode comprises a planar one end extending adjacent said first vertical sidewall; and wherein said vertical extraction electrode comprises a planar vertical extraction electrode, said planar one end of said first horizontal emitter electrode and said planar one end of said vertical extraction electrode forming an elongated electron emission gap therebetween.

6. The microelectronic field emitter of claim 5 further comprising:
a second insulating layer on said first horizontal face, said second insulating layer having a second planar vertical sidewall, spaced from and parallel to said first planar vertical sidewall; and
a planar vertical collector electrode on said second planar sidewall.

7. The microelectronic field emitter of claim 1 further comprising:
a second insulating layer on said first horizontal emitter electrode, said second insulating layer having a second vertical sidewall;
a second horizontal emitter electrode on said second insulating layer, with one end thereof extending adjacent said second vertical sidewall; and
a second vertical extraction electrode on said vertical second sidewall, with one end thereof extending adjacent said second horizontal emitter electrode, said one end of said second horizontal emitter electrode and said one end of said second vertical extraction electrode forming a second electron emission gap therebetween.

8. The microelectronic field emitter of claim 7 further comprising:
a third insulating layer on said horizontal face, said third insulating layer having a third vertical sidewall, said third vertical sidewall being spaced from said first and said second vertical sidewalls; and,
a vertical collector electrode on said third vertical sidewall.

9. The microelectronic field emitter of claim 1 further comprising a collector electrode on said horizontal face, adjacent said first vertical sidewall.

10. The microelectronic field emitter of claim 9 wherein said collector electrode comprises one of a light emissive material and an x-ray emissive material.

11. The microelectronic field emitter of claim 1 further comprising at least one intervening layer between said substrate and said first insulating layer.

12. A microelectronic field emitter comprising;
a substrate having a first face;
a first insulating layer on said first face, said first insulating layer having a first sidewall;
a first emitter electrode on said first insulating layer, with one end thereof extending adjacent said first sidewall; and
an extraction electrode on said first sidewall, with one end thereof extending adjacent said first emitter electrode, said one end of said first emitter electrode and said one end of said extraction electrode forming an electron emission gap therebetween,
wherein said first insulating layer comprises a first cylindrical insulating layer having a first cylindrical sidewall; wherein said first emitter electrode comprises a first circular emitter electrode on said first insulating layer; and wherein said extraction electrode comprises a cylindrical extraction electrode on said first sidewall, with said one end of said circular emitter electrode and said one end of said cylindrical extraction electrode forming a circular electron emission gap therebetween.

13. The microelectronic field emitter of claim 12 further comprising:
a second insulating layer on said first face surrounding said first insulating layer and having a second cylindrical sidewall concentric with said first cylindrical sidewall; and
a cylindrical collector electrode on said second sidewall.

14. A microelectronic field emitter comprising:
a substrate having a first face;
a first insulating layer on said first face, said first insulating layer having a first sidewall;
a first emitter electrode on said first insulating layer, with one end thereof extending adjacent said first sidewall;
an extraction electrode on said first sidewall, with one end thereof extending adjacent said first emitter electrode, said one end of said first emitter electrode and said one end of said extraction electrode forming an electron emission gap therebetween;
a second insulating layer on said first emitter electrode, said second insulating layer having a second sidewall; and a second extraction electrode on said second sidewall, with one end thereof extending adjacent said first emitter electrode, said one end of said first emitter electrode and said one end of said second extraction electrode forming a second electron emission gap therebetween.

15. A microelectronic field emitter comprising:

a substrate having a first face;

a first insulating layer on said first face, said first insulating layer having a first sidewall;

a first emitter electrode on said first insulating layer, with one end thereof extending adjacent said first sidewall;

an extraction electrode on said first sidewall, with one end thereof extending adjacent said first emitter electrode, said one end of said first emitter electrode and said one end of said extraction electrode forming an electron emission gap therebetween;

a second insulating layer on said first face, said second insulating layer having a second sidewall;

a second emitter electrode on said second insulating layer, with one end thereof extending adjacent said second sidewall, said one end of said first emitter electrode facing said one end of said second emitter electrode; and a second extraction electrode on said second sidewall, with one end thereof extending adjacent said second emitter electrode, said one end of said second emitter electrode and said one end of said second extraction electrode forming a second electron emission gap therebetween.

16. The microelectronic field emitter of claim 15 further comprising a conductive plate, parallel to and insulated from said first emitter electrode, said first emitter electrode and said conductive plate forming a capacitor for storing charge therein.

17. A microelectronic field emitter comprising:

a substrate having a first face;

a first insulating layer on said first face, said first insulating layer having a first sidewall;

a first emitter electrode on said first insulating layer, with one end thereof extending adjacent said first sidewall;

an extraction electrode on said first sidewall, with one end thereof extending adjacent said first emitter electrode, said one end of said first emitter electrode and said one end of said extraction electrode forming an electron emission gap therebetween;

a third insulating layer on said second emitter electrode, said third insulating layer having a third sidewall;

a third emitter electrode on said third insulating layer, with one end thereof extending adjacent said third sidewall; and a third extraction electrode on said third sidewall, with one end thereof extending adjacent said third emitter electrode, said one end of said third emitter electrode and said one end of said third extraction electrode forming a third electron emission gap therebetween.

18. A microelectronic field emitter comprising:

a substrate having a first face;

a first insulating layer on said first face, said first insulating layer having a first sidewall;

a first emitter electrode on said first insulating layer, with one end thereof extending adjacent said first sidewall; and an extraction electrode on said first sidewall, with one end thereof extending adjacent said first emitter electrode, said one end of said first emitter electrode and said one end of said extraction electrode forming an electron emission gap therebetween, wherein said one end of said emitter electrode overhangs said first sidewall.

19. A microelectronic field emitter comprising:

a substrate having a first face;

a first insulating layer on said first face, said first insulating layer having a first sidewall;

a first emitter electrode on said first insulating layer, with one end thereof extending adjacent said first sidewall; and an extraction electrode on said first sidewall, with one end thereof extending adjacent said first emitter electrode, said one end of said first emitter electrode and said one end of said extraction electrode forming an electron emission gap therebetween; and a conductive plate, parallel to and insulated from said first emitter electrode, said first emitter electrode and said conductive plate forming a capacitor for storing charge therein.

20. A microelectronic field emitter comprising:

a substrate having a horizontal face;

a first planar horizontal emitter electrode on said horizontal face, said first horizontal emitter electrode having a linear first end; and a first planar vertical extraction electrode on said horizontal face, said first vertical extraction electrode having a linear first end; said linear first end of said first horizontal emitter electrode and said linear first end of said first vertical extraction electrode extending adjacent one another to form an elongated linear electron emission gap therebetween.

21. The microelectronic field emitter of claim 20 further comprising a planar vertical collector electrode on said horizontal face, spaced from said first planar vertical extraction electrode, to form a cavity therebetween.

22. The microelectronic field emitter of claim 20 further comprising a second planar horizontal emitter electrode on said horizontal face.

23. The microelectronic field emitter of claim 22 wherein said first horizontal planar emitter electrode extends between said first horizontal face and said second horizontal planar emitter electrode.

24. The microelectronic field emitter of claim 22 further comprising a second planar vertical extraction electrode on said horizontal face, said second planar vertical extraction electrode having a linear first end, said linear first end of said second horizontal emitter electrode and said linear first end of said second vertical extraction electrode extending adjacent one another to form an elongated linear electron emission gap therebetween.

25. The microelectronic field emitter of claim 20 further comprising at least one intervening layer between said first planar horizontal emitter electrode and said horizontal face.

26. The microelectronic field emitter of claim 20 further comprising at least one intervening layer between said first vertical planar extraction electrode and said horizontal face.

27. A microelectronic field emitter comprising:

a substrate having a horizontal face;

a first horizontal emitter electrode on said horizontal face, said first horizontal emitter electrode having a first end; and a first vertical extraction electrode on said horizontal face, said first vertical extraction electrode having a first end; said first end of said first horizontal emitter electrode and said first end of said first vertical extraction electrode extending adjacent one another to form an electron emission gap therebetween;

wherein said first horizontal emitter electrode comprises a first horizontal circular emitter electrode and wherein said first vertical extraction electrode comprises a first vertical cylindrical extraction electrode, with said first end of said circular emitter electrode and said first end of said cylindrical extraction electrode forming a circular electron emission gap therebetween.

28. A microelectronic field emitter comprising:

a substrate having a horizontal face;

a first horizontal emitter electrode on said horizontal face, said first horizontal emitter electrode having a first end;

a first vertical extraction electrode on said horizontal face, said first vertical extraction electrode having a first end; said first end of said first horizontal emitter electrode and said first end of said first vertical extraction electrode extending adjacent one another to form an electron emission gap therebetween; and a horizontal conductive plate, insulated from said first horizontal emitter electrode, said first horizontal emitter electrode and said horizontal conductive plate forming a capacitor for storing charge therein.

* * * * *

UNITED STATES PATENT AND TRADEMARK OFFICE

CERTIFICATE OF CORRECTION

PATENT NO. : 5,144,191

DATED : September 1, 1992

INVENTOR(S) : Jones et al.

It is certified that error appears in the above-identified patent and that said Letters Patent is hereby corrected as shown below:

In the ABSTRACT, line 15, "multiple" should be --Multiple--.

Column 2, line 48, after "a", please insert --horizontal emitter electrode and a vertical extraction--.

Column 10, line 56, "On" should be --on--.

Signed and Sealed this

Fifth Day of October, 1993

Bruce Lehman

*Attest:*

BRUCE LEHMAN

*Attesting Officer*

*Commissioner of Patents and Trademarks*